United States Patent [19]

Ferretti

[11] 4,199,140

[45] Apr. 22, 1980

[54] PORTABLE WEIGHT LIFT AND FORCE RESISTIVE EXERCISER

[76] Inventor: Bruno Ferretti, 16 Squanto Rd., Woburn, Mass. 01801

[21] Appl. No.: 826,921

[22] Filed: Aug. 22, 1977

[51] Int. Cl.[2] ..... A63B 13/00

[52] U.S. Cl. ..... 272/123; 222/210; 222/465; 272/142

[58] Field of Search ..... 272/123, 122, 117, 142, 272/143, DIG. 4, 135, 137; 222/210, 215, 465

[56] References Cited

U.S. PATENT DOCUMENTS

| | | | |
|---|---|---|---|
| 980,025 | 12/1910 | Titus | 272/122 |
| 984,721 | 2/1911 | Titus | 272/122 |
| 1,815,863 | 7/1931 | Noe | 272/142 |
| 3,307,752 | 3/1967 | Anderson | 222/465 |
| 3,311,374 | 3/1967 | Wittenberg et al. | 272/123 |
| 3,572,702 | 3/1971 | Dorn | 272/123 |
| 3,638,834 | 1/1972 | Goodrich et al. | 222/465 |
| 4,029,312 | 6/1977 | Wright | 272/123 |

*Primary Examiner*—William R. Browne
*Attorney, Agent, or Firm*—Wolf, Greenfield & Sacks

[57] ABSTRACT

A container has a body member having a pair of flat opposite major surfaces and an elongated handle having a longitudinal axis parallel to the planes of the major surfaces. A circular hole for receiving a shaft is formed substantially in the volumetric center of the container and the hole is surrounded by a key device to lock the shaft in the container. The container has an opening for filling and a cap for closing the opening. Preferably, the axis of the handle is located nonsymmetrically between the planes of the major surfaces and is supported by structure integral and continuous with, but narrower than the sidewalls of the container between the major surfaces. Preferably in the end of the container opposite the handle there is a slot communicating with a cylindrical hole in the container so that a rubber or metal resilient member may be inserted through the slot and secured by a dowel in the cylindrical hole. Several such containers may be easily stacked and transported to any location, filled with water, sand, concrete, etc., and used in combination with a shaft as a bar bell or in combination with a rubber band or spring as a resilient force exerciser.

12 Claims, 6 Drawing Figures

PORTABLE WEIGHT LIFT AND FORCE RESISTIVE EXERCISER

BACKGROUND OF THE INVENTION

The invention relates to exercising equipment and more particularly to a combination weight lift and resilient force exercise system.

Weight lift and resilient force-resistive exercising systems have become an important means for maintaining physical fitness not only among professional and amateur athletes and body builders but also by the general public. Conventional weight lift type systems consist of heavy metal disc-shaped weights which are fastened to the end of a bar or shaft. The conventional resilient force-resistive type exerciser consists of a series of springs one end of which is attached to a heavy frame or a wall and on the other end off which are attached gripping handles.

Conventional weight lift type or resilient force-resistive type exercisers present a number of problems to many of the persons interested in maintaining a physical training routine. Many such persons must constantly travel, such as professional or amateur athletes, and almost all such persons travel for extended periods at least occasionally, such as on vacations or on business trips. Conventional exercisers are difficult to move and thus usually cannot be taken on such trips. However, it is important that physical training routines be continued during such trips since failure to exercise for even a few days can significantly affect muscle tone. Thus, it is highly desirable that such physical exercise systems be portable. At the same time, however, the exercise systems must be safe to use since an injury might not only set back a training routine but may also damage muscles which a person is trying to develop.

One way to increase the portability of any exercise system is to reduce the number of parts, which can be done by using a single mode exercise system. However, different muscles of the human body require different types of forces and motions for proper development. Thus, it is desirable that even a portable exercise system be suitable for both the weight lift type and the resilient force-resistive type exercises. In addition, a variety of systems serves to make exercising more enjoyable.

Portable exercise systems which can be easily and safely stacked are important not only to travelers but also to persons who have limited room in which to exercise or to store the system. Many exercise systems have been designed which purport to solve these problems. Thus, the functional design of the exercising equipment is well developed and includes many United States patents, among the most relevant which are U.S. Pat. Nos. 3,311,374 and 3,572,702.

SUMMARY OF THE INVENTION

An important object of the present invention is to provide a combination weight lift type and resilient force-resistive type exercise system which is portable and safe to use.

Another object of this invention is to achieve the above object in an exercise system that is relatively inexpensive to manufacture and at the same time has a relatively pleasing physical appearance that is not entirely out of place in a home, office or the like.

Still another object of the invention is to provide an exercise weight that can be used in combination with a shaft and a resilient force-resistive element to provide an exercise system acieving one or more of the foregoing objects.

The invention comprises a hollow container having a body and a handle. The body has at least a pair of substantially flat opposite surfaces. The handle is elongated and has a longitudinal axis parallel to the planes of the major surfaces of the body. There are means supporting and connecting the handle to the body member preferably locating the handle non-symmetrically between the planes of the major surfaces. Means for filling the container with a heavy substance such as water, sand, concrete, etc., and a means for sealing a container after it is filled are provided. Preferably there are means for receiving and securing a shaft along an axis passing substantially through the volumetric center of the container and perpendicular to the major surfaces. Preferably the end of the container opposite the handle has a means for securing a resilient force-resister so that the line of resistive force passes through the handle.

A single such container, when filled with a heavy substance forms an exercising device which can be securely gripped for safe handling, and has a very pleasing appearance. When two or more such containers are combined with a bar or shaft they form an exceptionally stable and handsome appearing bar bell exercise system. In combination with a heavy rubber band, a spring, etc. such containers form a resilient force-resistive exercise system that can be securely grasped by both feet and hands or securely anchored on any convenient rod or pipe. When the containers are emptied they are extremely light weight and they can be stably and compactly stacked for easy transportation and/or storage.

Numerous other features, objects and advantages of the invention will now become apparent from the following detailed description when read in conjunction with the accompanying drawings in which:

BRIEF FIGURE DESCRIPTION

DESCRIPTION OF THE PREFERRED EMBODIMENT

Figure 1:
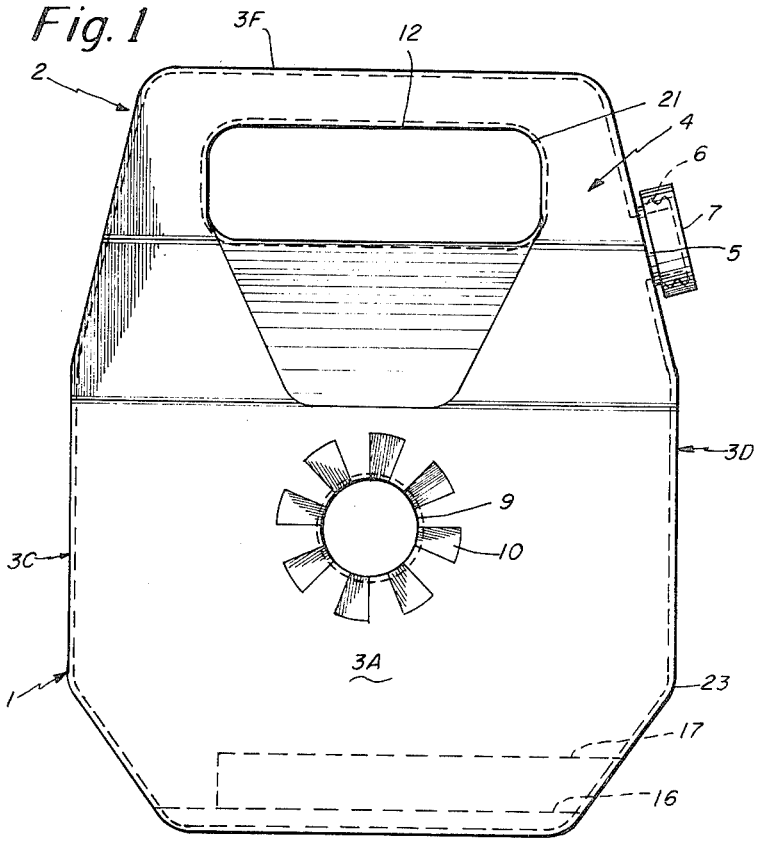
FIG. 1 is an elevational view of the face of an exercising device according to the invention.
Figure 2:
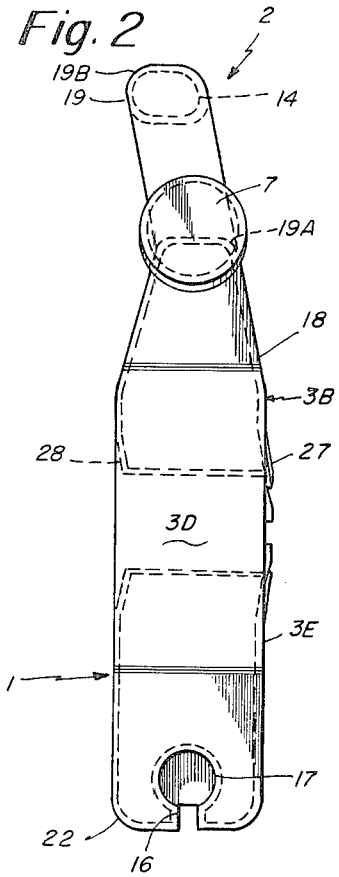
FIG. 2 is a side elevational view of the same exercising device.

FIG. 1 is an elevational view of the face or broad side of the exercising device according to the invention and FIG. 2 is a narrow side elevational view of the same device. The device has body indicated generally at 1 and a handle indicated generally at 2. The body 1 has at least two substantially flat major surfaces 3A and 3B. By substantially flat it is meant that the surfaces are sufficiently flat so that the container will be stable and not roll when placed on that surface, however, the surface may have indentations or slight projections as will be discussed below. The handle 2 has a longitudinal axis that is located non-symmetrically between the planes of major surfaces 3A and 3B. Means 4 for supporting and connecting handle 2 with body 1 are integral and continuous with sidewalls 3C and 3D of the body and are narrower than the sidewalls. The container has an opening 5 which may be filled with a heavy fluid such as water, sand, concrete, etc. Threaded cap 7 screws over and closes the opening formed by the cylindrical threaded tube 6 which defines hole 5. A cylindrical opening 9 for receiving a shaft or bar passes through the volumetric center of the container along a line perpendicular to the major surfaces 3A and 3B. The size of opening 9 can be varied over a narrow range. Cylindrical key 10 formed with stepped segments provides means to secure the containers to the shaft and to interengage adjacent containers. The handle 2 of the container has a rectangular opening 12 along an axis perpendicular to broad surfaces 3A and 3B. Opening 12 is of a size so that a hand may be easily inserted through it in sliding-fit engagement, in order to lift the container. A portion of handle 2 just above opening 12 has a solid insert 14 to strengthen it.

The embodiment of the invention shown also has a means for securing a resilient force-resistive element. This consists of a slot 16 formed in the end of the container opposite the handle and a cylindrical hole 17 communicating with slot 16 (best shown in FIG. 2). Preferably, the handle end 2 is contiguous to broad surface 3B at its proximate end 19A, and is contiguous to the plane defined by the broad surface 3A near its distal end 19B.

The above-described container including threaded cylinder 6, caps 7 and handle insert 14 may be formed of a suitable plastic. It also may be formed of metal or any other sufficiently strong and moldable or formable material. All corners such as at 21, 22 and 23 are rounded and smooth.

When the above described container is filled with a heavy substance such as water, sand, or cement etc., it forms a stable, safe and pleasing appearing exercising device. The hand inserted through opening 12 fits very comfortably and securely around the handle 2 of the container. The plastic surface about the handle may be textured so that it minimizes slipping when the hand is heavily perspiring. In use, the hand is preferably inserted so that side 3A faces the user's body. In this position, there is a minimum of interference between body 1 of the container and forearms and body of the person using the exerciser. In addition, when the exerciser must be put down, the angled handle tends to cause the body 1 of the container to swing out away from the person exercising so that there is less danger of the exerciser striking toes, shins, etc. The rounded corners protect against scrapes and scratches while exercising. The flat surfaces protect against the exerciser falling over or rolling when it is set down. In addition, the plastic surface of the container lends itself to texturing to give a decorative appearance to the container which blends comfortably with home or office.

Another feature of the invention is that it is easily portable. If a temporary filler such as water is used the container may be emptied after use, and the empty container is very light in weight. Whether a permanent or temporary filler is used, the flat surfaces of the container and its relatively boxy shape enables many such containers to be stably and compactly stacked for transportation or storage. The containers are particularly stable when they are stacked with the surface 3B of one container facing the surface 3A of the next container. In such a stack, projection 27 of key 10 fits neatly into indentation 28 of key 10 in the adjacent container, preventing horizontal slippage of the containers with respect to one another. In addition, the fact that the distal end 19B of the handle 2 aligns with the plane of surface 3A insures that the lower-most container firmly sits on the table, floor etc. and forms a very stable flat platform for stacking the other containers. The placement of cap 7 insures that there is no interference between the caps of adjacent containers when stacked in the above manner.

Figure 3:
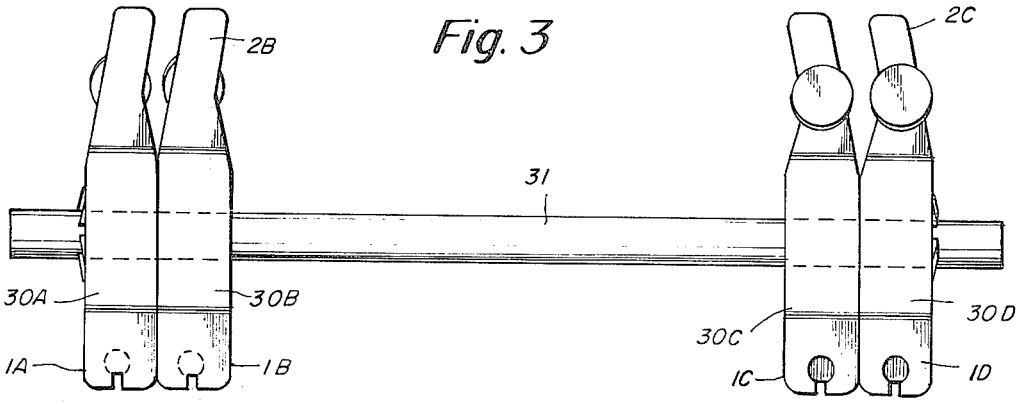
FIG. 3 is a diagrammatic illustration of a bar bell exercise system formed by four of the exercising devices in combination with a bar according to the invention.

FIG. 3 shows the bar bell type exercising system formed by the combination of four containers, 30A to 30D with a cylindrical bar 31. Bar 31 is inserted through opening 9 in each of the containers. As in conventional bar bell systems, normally an equal number of containers are spaced an equal distance from each end of the bar 31. Containers 30A–30D may be filled or partially filled, although it is preferable that the containers be filled, especially when a flowable filler such as water is used. Since opening 9 passes through the volumetric center of the container when the container is filled, presumably with a substance of uniform density, the weight of the container is uniformly distributed about bar 31. If one or more of the containers is partially filled, the filler material will settle in the lower part of body end 1A–1D and thus the bar bell system will still be stable for exercising. The user of the bar bell system may grasp the bar bell as in conventional bar bell systems, that is along bar 31 at some point between container 30B and 30C. However, unlike conventional bar bell systems, it also may be grasped by means of handles 2B and 2C. This additional manner of grasping the bar bell system not only expands the variety of exercises that can be performed by the system, but also, for some exercising, presents a more stable grasping method with less danger of slippage of the bar bell system. The resulting bar bell system is a much more stable one than conventional bar bell systems since it will not roll no matter which of the sides 3C, 3D, 3E, 3F, 3G, 3H, etc. about the circumference of opening 9 is placed downward. As in conventional bar bell systems, any number of containers can be used in combination with bar 31 within the limits of the strength of the user and the length of the bar.

Figure 4:
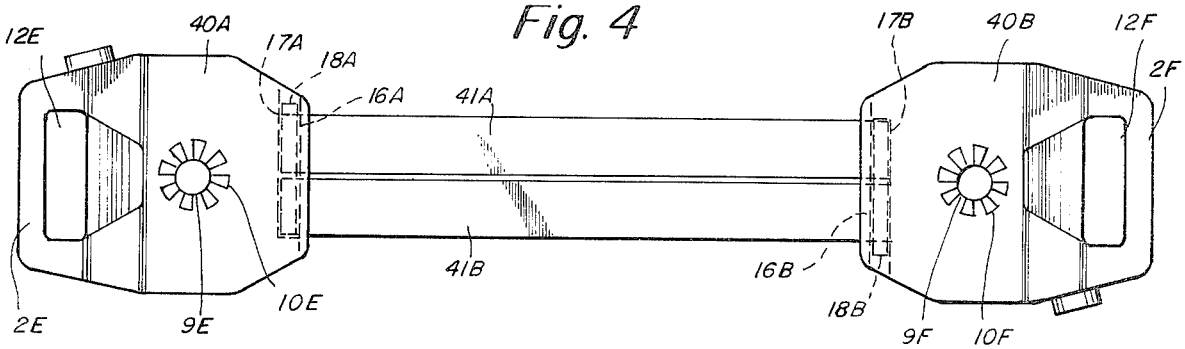
FIG. 4 is a diagrammatic illustration of a resilient force-resistive exercise system formed by two of the exercising devices in combination with two rubber bands according to the invention.

FIG. 4 shows a resilient force-resistive exercising system formed by the combination of two of the above-described containers 40A and 40B and a pair of heavy rubber bands 41A and 41B. The rubber bands 41A and 41B are secured to containers 40A and 40B by slipping the ends of the bands through slots 16A and 16B and then inserting dowels 18A and 18B into slots 17A and 17B respectively so that the looped ends of rubber bands 41A and 41B passes around dowels 18A and 18B. The resulting exerciser may be used by grasping handle 2E in one hand and handle 2F in the other hand. Or one of handles 2E and 2F may be held down by a foot and the other handle may be grasped by one or both hands. In addition, the exerciser may be used by placing one of holes 9E or 9F on a rod, pipe or any firmly secured cylindrically shaped object. Alternatively, if the available support is rectangularly shaped, such as a rectangular board, post or brace, then either of handle openings 12E or 12F may be placed over the object. If either of holes 9E or 9F is used as the point of securing the exerciser then key 10E or 10F may be tightened about a support rod, bar, etc. to lock the anchored end of the exerciser in place.

The resilient force-resistive exerciser formed in the above manner is also significantly safer than conventional such exercisers. Key 10E or 10F provides a means of securing the anchored end of the exerciser much more firmly than with the conventional exercisers which are only equipped with handles. Handles 2E and 2F provide for a secure, comfortable non-slip hand hold. Should one of the rubber bands 41A and 41B break, or if the anchor end of the exerciser should slip, the container forms an effective shield for the hand which is grasping it. In addition, the smooth rounded corners of all parts of the exerciser prevents scrapes and scratches.

Figure 5:
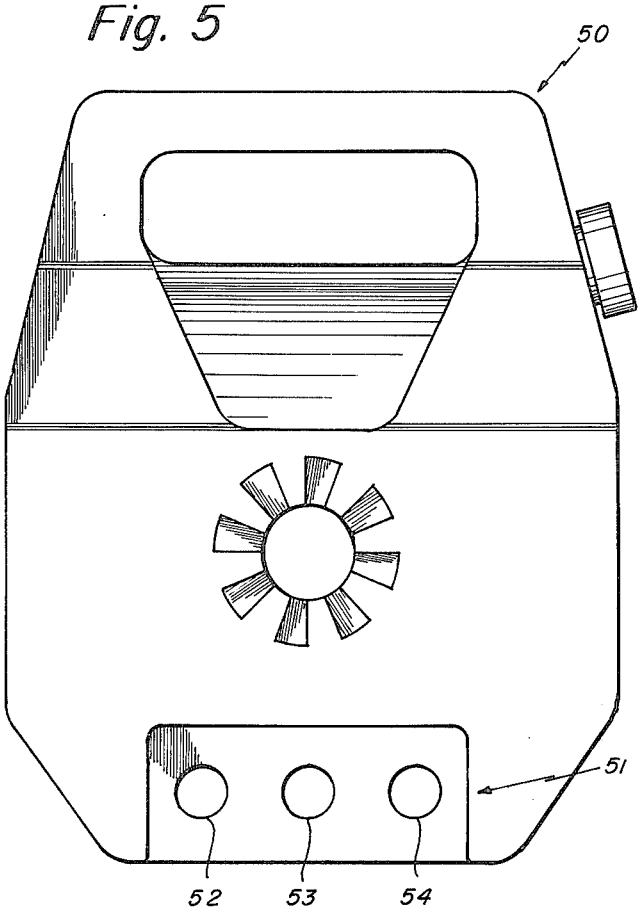
FIG. 5 is an elevational view of the face of an exercising device according to another embodiment of the invention.
Figure 6:
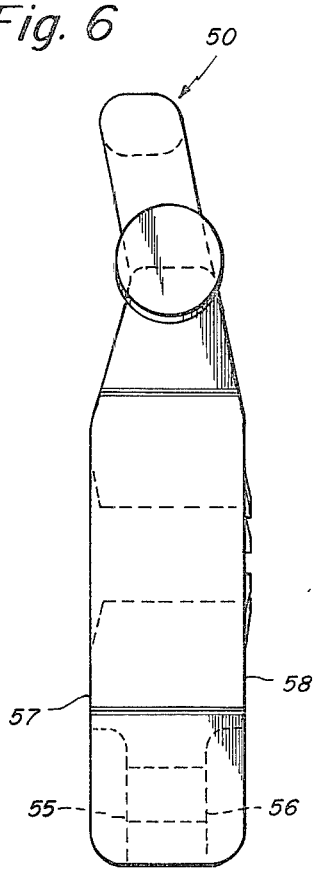
FIG. 6 is a side elevational view of the embodiment shown in FIG. 5.

Shown in FIGS. 5 and 6 is another embodiment of a container 50 having features similar to the container shown in FIGS. 1-4. In this embodiment of the container, a resilient force-resistive exercising system is formed by attaching rubber bands or springs (not shown) to securing means shown generally as 51. Securing means 51 comprises a plurality of holes 52,53, and 54 configured to extend from a front inner surface 55 to a rear inner surface 56 as shown in FIG. 6. It can be appreciated that different quantities of holes may be formed in container 50 depending upon the type, quantity and nature of the band or spring component.

Front and rear inner surfaces 55 and 56 respectively are configured to be indented from a front and rear surface 57 and 58 respectively to allow the springs or band when attached to the container to be substantially flush with surfaces 57 and 58. To secure the spring or band device to securing means 51, dowels (not shown) may be used to pass through the end loops positioned on surfaces 55 and 56 and holes 52, 53, and 54. In addition, for those springs and band devices having at their ends clasping means, such clasping means can be positioned to be insertable either partially or fully into holes 52, 53 and 54. It can be appreciated by those skilled in the art that there are several ways of attaching springs or band devices to securing means 51 either with or without such devices as dowels, clamps, and the like.

In the resilient force-resistive exerciser mode, the containers may either be empty, or one or more of them may be filled. This feature substantially increases the variety of types of exercises that may be performed with the system.

It is evident that those skilled in the art may now make numerous uses and modifications of and departures from the specific embodiments described herein without departing from the specific embodiments described herein without departing from the inventive concepts. For example, the container may be made completely rectangular, pentangular, hexangular, or circular, etc. and the form and location of the handle may be varied over a wide range.

What is claimed is:

1. A hollow container for retaining weight bearing material comprising:

a non-collapsible body member having at least a pair of substantially flat confronting major surfaces, and a pair of minor surfaces which join said major surfaces around a peripheral edge of said major surfaces said body member defining a first portion of an enclosure for a weight bearing material, a non-collapsible elongated handle member having a longitudinal axis, said handle member defining a second portion of said enclosure for weight bearing material;

non-collapsible means integral with said non-collapsible body member along a lower end and supporting a portion of said non-collapsible handle member along an upper end so that said handle member and said integral means form an elongated hand opening, said longitudinal axis of said handle member being parallel to the planes in which said major surfaces lie, said means for supporting defining a third portion of said enclosure for said weight bearing material, whereby said first, second and third portions of the enclosure define a single chamber for weight bearing material, means for receiving and securing to a shaft along an axis passing substantially through the volumetric center of said container and perpendicular to said major surfaces whereby said receiving and securing means is adapted to minimize rotation of the container about the shaft and provide a nesting arrangement for a plurality of containers to nest with each other, means for receiving a resilient force resistor device at an end of said container opposite said handle member, means forming an opening in said container for filling it, and closure means for sealing said opening means.

2. A container in accordance with claim 1 wherein said longitudinal axis of said non-collapsible handle member lies between the planes of said major surfaces.

3. A container in accordance with claim 2 wherein said axis of said non-collapsible handle member is non-symmetrically locatd in relation to said planes.

4. The container in accordance with claim 3 wherein said non-collapsible integral means has converging and confronting major walls integral and continuous with said major surfaces of said body member and said handle member so that said major walls are closer together at said handle member than at said body member.

5. A container as set forth in claim 4 wherein said axis of said handle member does not pass through the center of gravity of said container.

6. A container in accordance with claim 5 and further comprising said container being filled with a weight bearing substance.

7. The container in accordance with claim 1 and further comprising a means for securing a resilient force-resister at the end of said container opposite said handle member.

8. The container in accordance with claim 7 wherein said means for securing comprises means forming a cylindrical hole parallel to and between said major surfaces, means forming a slot through the end of said container opposite said handle and parallel to the axis of and communicating with said cylindrical hole, a resilient force resistor, and a dowel means adapted to fit within said cylindrical hole with a loop of said resilient force-resister passing through said slot and about the circumference of the dowel means, thereby securing said force-resister to said container.

9. A container according to claim 7 wherein said means for securing a resilient force-resister at the end of said container opposite said handle comprises a plurality of cylindrical holes between a front inner surface and a rear inner surface, said front inner surface and said rear inner surface being substantially parallel to and inward from said flat opposite major surfaces.

10. In combination, a hollow container for retaining weight bearing material comprising:

a rigid body member having at least a pair of substantially flat facing major surfaces, said body member defining a first portion of an enclosure for a weight bearing material, a rigid elongated handle member having a longitudinal axis, said handle member defining a second portion of said enclosure for said weight bearing material, means integral with said rigid body member and supporting said handle member with its longitudinal axis parallel to the planes in which said surfaces lie, said means for supporting defining a third portion of said enclosure for said weight bearing material, a means forming an opening in said container for filling it, a closure means for sealing said means forming an opening and further comprising a means for receiving and securing to a shaft along an axis passing substantially through the volumetric center of said container and perpendicular to said major surfaces wherein said means for receiving is further adapted so that a portion of said means for receiving at one of said major surfaces fits into a portion of said means for receiving at the other of said major surfaces thereby permitting a nesting engagement of said surfaces when a plurality of containers are in contact with each other.

11. In a combination comprising:

a non-collapsible body member having at least a pair of substantially flat confronting major surfaces and a pair of minor surfaces which join said major surfaces around a peripheral edge of said major surfaces said body member defining a first portion of an enclosure for a weight bearing material, a non-collapsible elongated handle member having a longitudinal axis, said handle member defining a second portion of said enclosure for weight bearing material;

non-collapsible means integral with said non-collapsible body member along a lower end supporting a portion of said non-collapsible handle member along an upper end so that said handle member and said integral means form an elongated hand opening, said longitudinal axis of said handle member being parallel to the planes in which said major surfaces lie, said means for supporting defining a third portion of said enclosure for said weight bearing material, whereby said first, second and third portions of the enclosure define a single chamber for weight bearing material, means forming an opening in said container for filling it, and closure means for sealing said opening means, an elongated shaft, a means for receiving and securing the shaft along an axis passing substantially through the volumetric center of said container and perpendicular to said major surfaces, whereby said receiving and securing means is adapted to minimize rotation of the container about the shaft and provide a nesting arrangement for a plurality of containers to nest with each other, a resilient force resistor, a means for securing the resilient force resistor at the end of said container opposite said handle member and said container being filled with a heavy substance.

12. An exercising device in accordance with claim 11 and further comprising a resilient force resister adapted to fit into said means for securing.

* * * * *

UNITED STATES PATENT AND TRADEMARK OFFICE

CERTIFICATE OF CORRECTION

PATENT NO. : 4,199,140

DATED : April 22, 1980

INVENTOR(S) : Bruno Ferretti

It is certified that error appears in the above—identified patent and that said Letters Patent is hereby corrected as shown below:

Column 1, line 18, change "off" to --of--.

Column 2, line 1, change "acieving" to --achieving--.

Column 5, lines 52-53, delete "the specific embodiments described herein without departing from".

Signed and Sealed this

*Fifth* Day of *August 1980*

[SEAL]

*Attest:*

SIDNEY A. DIAMOND

*Attesting Officer*

*Commissioner of Patents and Trademarks*